US008699934B2

(12) United States Patent
Wakayama

(10) Patent No.: US 8,699,934 B2
(45) Date of Patent: Apr. 15, 2014

(54) CLEANING MECHANISM AND IMAGE FORMING APPARATUS PROVIDED WITH THE SAME

(75) Inventor: Kei Wakayama, Osaka (JP)

(73) Assignee: Kyocera Document Solutions Inc. (JP)

( * ) Notice: Subject to any disclaimer, the term of this patent is extended or adjusted under 35 U.S.C. 154(b) by 33 days.

(21) Appl. No.: 13/490,698

(22) Filed: Jun. 7, 2012

(65) Prior Publication Data

US 2012/0321364 A1 Dec. 20, 2012

(30) Foreign Application Priority Data

Jun. 20, 2011 (JP) ..... 2011-136505

(51) Int. Cl.
*G03G 21/00* (2006.01)

(52) U.S. Cl.
USPC ..... 399/357; 399/274; 399/284; 399/350; 399/351

(58) Field of Classification Search
USPC ..... 399/273, 274, 283, 284, 350, 351, 357
See application file for complete search history.

(56) References Cited

U.S. PATENT DOCUMENTS

| | | | | |
|---|---|---|---|---|
| 2004/0057747 | A1* | 3/2004 | Michlin | 399/106 |
| 2006/0216072 | A1* | 9/2006 | Leemhuis et al. | 399/284 |
| 2008/0050153 | A1* | 2/2008 | Mori et al. | 399/284 |
| 2008/0101833 | A1* | 5/2008 | Morishita | 399/351 |
| 2009/0142108 | A1* | 6/2009 | Blanck et al. | 399/284 |
| 2010/0166452 | A1* | 7/2010 | Leemhuis et al. | 399/103 |
| 2010/0189472 | A1* | 7/2010 | Mori et al. | 399/284 |

FOREIGN PATENT DOCUMENTS

| | | |
|---|---|---|
| JP | 64-59285 | 3/1989 |
| JP | 2005-316086 | 11/2005 |
| JP | 2006-91614 | 4/2006 |
| JP | 2006-235377 | 9/2006 |

* cited by examiner

*Primary Examiner* — David Gray
*Assistant Examiner* — Francis Gray
(74) *Attorney, Agent, or Firm* — Gerald E. Hespos; Michael J. Porco; Matthew T. Hespos

(57) ABSTRACT

A cleaning mechanism includes a rubbing roller, a bearing, a toner amount restricting plate, and a bracket. The rubbing roller is abrasively contacted with the surface of a photosensitive drum. The bearing rotatably supports the rubbing roller. The toner amount restricting plate restricts the amount of toner adhered to the surface of the rubbing roller. The bracket holds the toner amount restricting plate in a state that the toner amount restricting plate is contacted with the rubbing roller. The bracket has a bearing holding portion which holds the bearing, and a toner amount restricting plate mounting portion to which the toner amount restricting plate is fixedly mounted. The bearing holding portion and the toner amount restricting plate mounting portion continue to each other via a first bent portion.

3 Claims, 11 Drawing Sheets

CLEANING MECHANISM AND IMAGE FORMING APPARATUS PROVIDED WITH THE SAME

This application is based on Japanese Patent Application No. 2011-136505 filed on Jun. 20, 2011, the contents of which are hereby incorporated by reference.

BACKGROUND

The present disclosure relates to a cleaning mechanism for cleaning a photosensitive drum, and an image forming apparatus incorporated with the same.

An image forming apparatus as exemplified by a copier, a printer, a facsimile machine or a complex machine having the functions of these devices is provided with a cleaning mechanism for removing matter adhered to the surface of a photosensitive drum therefrom. In the case of a photosensitive drum using e.g. an amorphous silicon(a-Si)-based material, the drum surface is hard. Therefore, it is difficult to scrape off the matter adhered to the drum surface even by contacting a cleaning blade made of a resin with the drum surface.

In view of the above, as a conventional art, for removing matter adhered to the drum surface by contact, there has been proposed a cleaning mechanism including a rubbing roller which is pivotally pressed against a photosensitive drum, and a toner amount restricting plate which is contacted with the rubbing roller while pivotally moving coaxially with the rubbing roller.

In the cleaning mechanism, toner transported via e.g. a photosensitive drum is adhered to the surface of the rubbing roller. The rubbing roller is allowed to remove the matter adhered to the surface of the photosensitive drum by being contacted with the surface of the photosensitive drum, with use of the toner adhered to the surface of the rubbing roller as an abrasive agent. The toner amount restricting plate is contacted with the rubbing roller with a predetermined amount of bite|[K1] for adjusting the amount of toner on the surface of the rubbing roller to a proper amount.

The toner amount restricting plate is fixed to a bracket that is fixed to bearings of the rubbing roller. The bracket has bearing holding portions for holding the bearings, a toner amount restricting plate positioning portion for positioning the toner amount restricting plate in contact with a lower end of the toner amount restricting plate, and a toner amount restricting plate fixing portion for fixing the toner amount restricting plate positioned by the toner amount restricting plate positioning portion by a hot-melt process or a like process. The bearing holding portions, the toner amount restricting plate positioning portion, and the toner amount restricting plate fixing portion are formed into a one-piece member by bending a metal sheet or a like member.

More specifically, a metal sheet is bent at a portion (first bent portion) between the bearing holding portion and the toner amount restricting plate positioning portion, and is bent at a portion (second bent portion) between the toner amount restricting plate positioning portion and the toner amount restricting plate fixing portion. Thus, there are two bent portions between the bearing holding portion and the toner amount restricting plate fixing portion.

In the bracket of the cleaning mechanism as constructed above, a positioning surface of the toner amount restricting plate positioning portion which continues from the bearing holding portion via the first bent portion is defined as reference attachment position of the toner amount restricting plate. Further, the toner amount restricting plate is attached to an attachment surface of the toner amount restricting plate fixing portion which continues from the bearing holding portion via the first and second bent portions.

In the above configuration, in the case where the bending angle of the attachment surface varies within the dimensional tolerance in e.g. forming the bracket, the amount of bite of the toner amount restricting plate greatly changes with respect to the rubbing roller. As a result, the ability of restricting the toner amount (toner transport amount) on the surface of the rubbing roller, in other words, a toner restricting force may be unstable depending on the toner amount restricting plate.

For instance, in the case where the toner restricting force is weak because the amount of bite of the toner amount restricting plate is small, the amount of toner adhered to the surface of the rubbing roller i.e. a so-called toner transport amount on the surface of the rubbing roller increases, which causes drawbacks such as toner drop or formation of pinholes. On the other hand, in the case where the toner restricting force is strong because the amount of bite of the toner amount restricting plate is large, the toner transport amount on the surface of the rubbing roller is small. As a result, the abrasive force may be insufficient, which may cause drawbacks such as image blurring or wearing of the cleaning blade.

Further, in the above configuration, the toner amount restricting plate is attached to the toner amount restricting plate fixing portion which continues from the bearing holding portion via the two bent portions. As a result, it is difficult to sufficiently secure the area for the attachment surface of the toner amount restricting plate fixing portion, and the toner amount restricting plate may be peeled off from the toner amount restricting plate fixing portion if the toner amount restricting plate is attached to the toner amount restricting plate fixing portion by ordinary adhesive means such as a double-sided adhesive tape. This necessitates use of a process such as a hot-melt process capable of providing a strong adhesive force for preventing peeling off of the toner amount restricting plate, and may affect the number of assembling steps.

In view of the above, an object of the present disclosure is to provide a cleaning mechanism capable of suppressing variation in the amount of bite of a toner amount restricting plate, while enhancing the assembling workability, and an image forming apparatus provided with the same.

SUMMARY

A cleaning mechanism according to an aspect of the present disclosure is a cleaning mechanism for removing matter adhered to a surface of a photosensitive drum. The cleaning mechanism includes a rubbing roller, a bearing, a toner amount restricting plate, and a bracket. The rubbing roller is abrasively contacted with the surface of the photosensitive drum. The bearing rotatably supports the rubbing roller. The toner amount restricting plate restricts the amount of toner adhered to the surface of the rubbing roller. The bracket holds the toner amount restricting plate in a state that the toner amount restricting plate is contacted with the rubbing roller. The bracket has a bearing holding portion which holds the bearing, and a toner amount restricting plate mounting portion with a mounting surface to which the toner amount restricting plate is fixedly mounted. The bearing holding portion and the toner amount restricting plate mounting portion continue to each other via a first bent portion.

Further, an image forming apparatus according to another aspect of the present disclosure includes a photosensitive drum and the aforementioned cleaning mechanism. The cleaning mechanism is adapted to remove matter adhered to a surface of the photosensitive drum.

These and other objects, features and advantages of the present disclosure will become more apparent upon reading the following detailed description along with the accompanying drawings.

DETAILED DESCRIPTION

Figure 1:
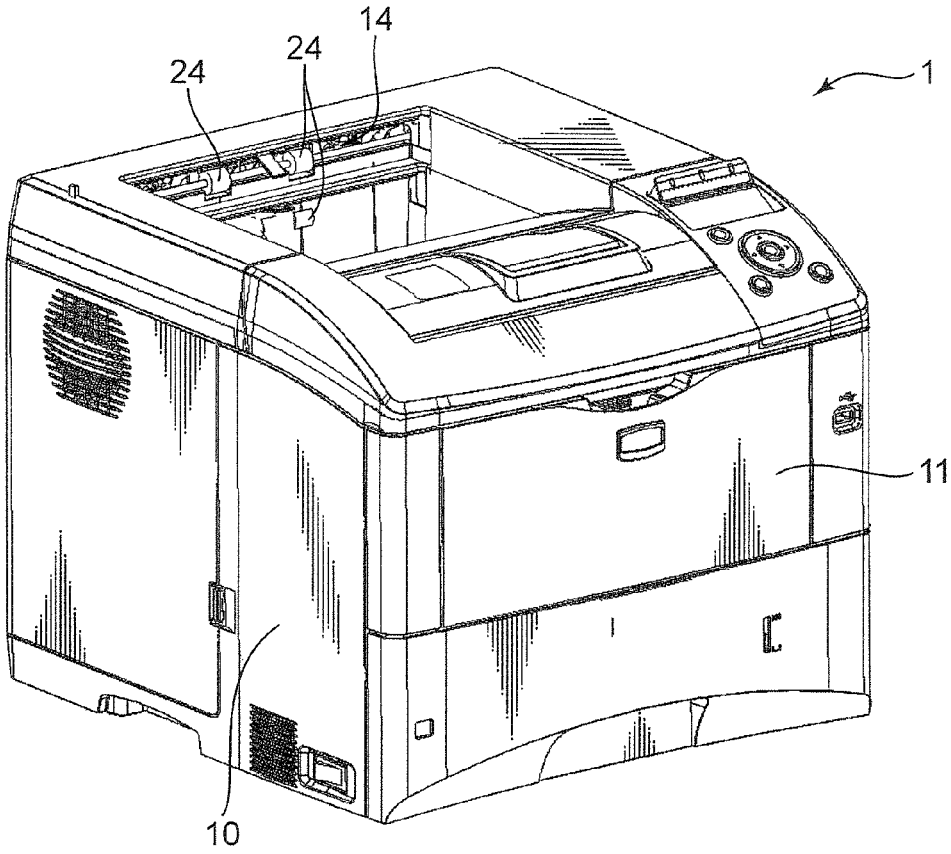
FIG. 1 is a perspective view of an image forming apparatus embodying the present disclosure.
Figure 2:
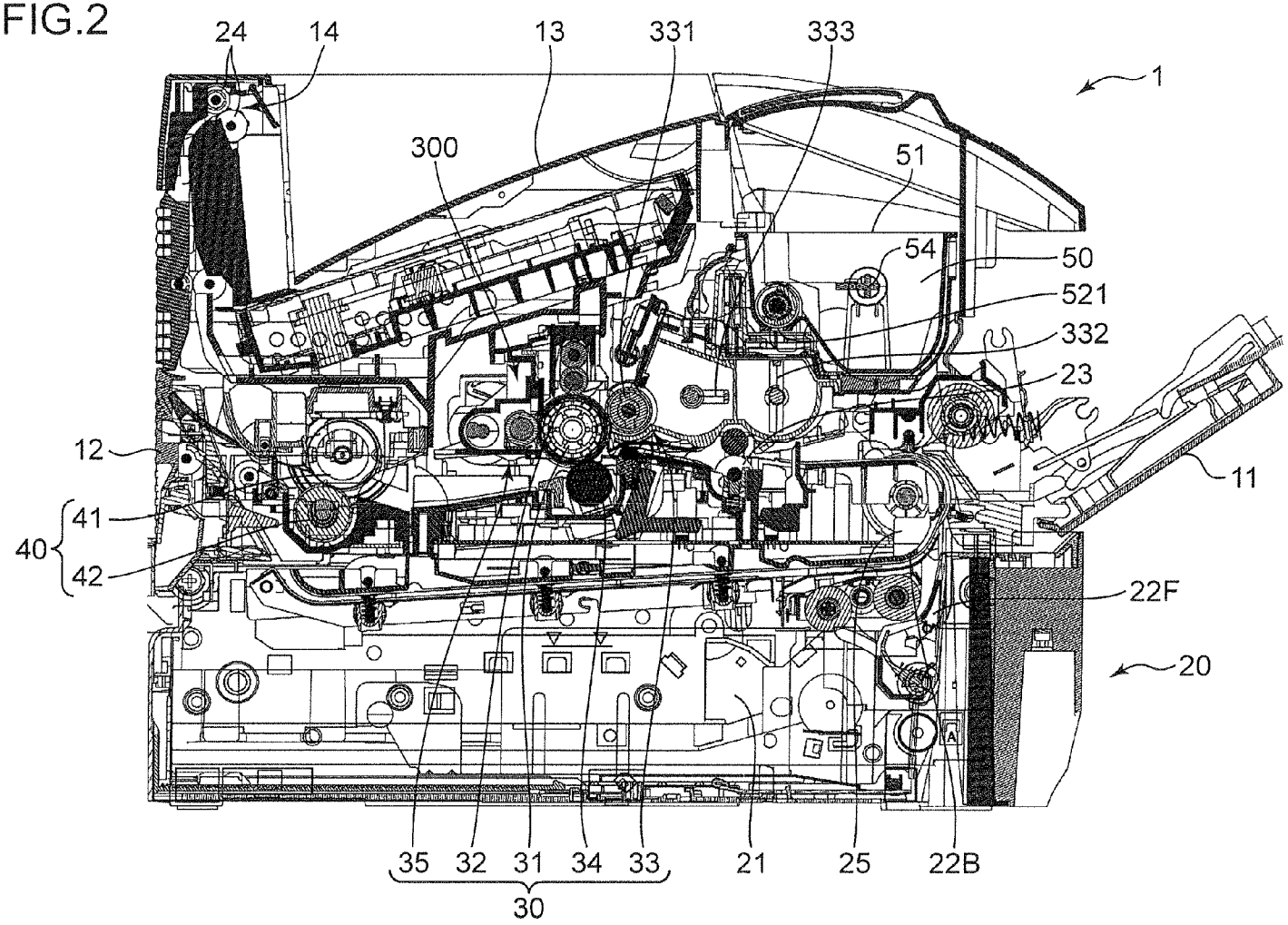
FIG. 2 is a cross-sectional view showing an internal structure of the image forming apparatus shown in FIG. 1.

In the following, an embodiment of the present disclosure is described referring to the drawings. FIGS. 1 and 2 show a monochromatic printer, as an example of an image forming apparatus 1 embodying the present disclosure. Alternatively, the image forming apparatus may be a copier, a facsimile machine or a complex machine provided with the functions of these devices; or may be a color image forming apparatus for forming a color image.

The image forming apparatus 1 shown in FIGS. 1 and 2 includes a housing body 10 having a casing structure of a substantially rectangular parallelepiped shape, a sheet feeding unit 20 to be housed in the housing body 10, an image forming unit 30, a fixing unit 40 and a toner container 50.

A front cover 11 and a rear cover 12 are respectively provided at a front surface side (right side in FIG. 2) and a rear surface side of the housing body 10. A user is allowed to take out the toner container 50 from the front surface side of the housing body 10 at the time of toner shortage by opening the front cover 11. The rear cover 12 is a cover to be opened for jammed sheet removal or maintenance service. Each of the image forming unit 30 and the fixing unit 40 is allowed to be taken out from the rear surface side of the housing body 10 by opening the rear cover 12. Further, a sheet discharge unit 13 for discharging sheets after image formation is provided on the top surface of the housing body 10.

The sheet feeding unit 20 includes a sheet cassette 21 for containing sheets for image formation therein. The sheet cassette 21 is provided with a sheet housing space in which a bundle of sheets are contained, a lift plate for lifting up the bundle of sheets for sheet feeding, and a pickup roller for dispensing the bundle of sheets in the sheet cassette 21 one by one from an uppermost sheet of the sheet bundle.

The image forming unit 30 performs an image forming processing of forming a toner image on a sheet to be fed from the sheet feeding unit 20. The image forming unit 30 includes a photosensitive drum 31 and various elements disposed around the photosensitive drum 31, that is, a charging device 32, an exposure device (not shown), a developing device 33, a transfer roller 34 and a cleaning mechanism 35.

Figure 3:
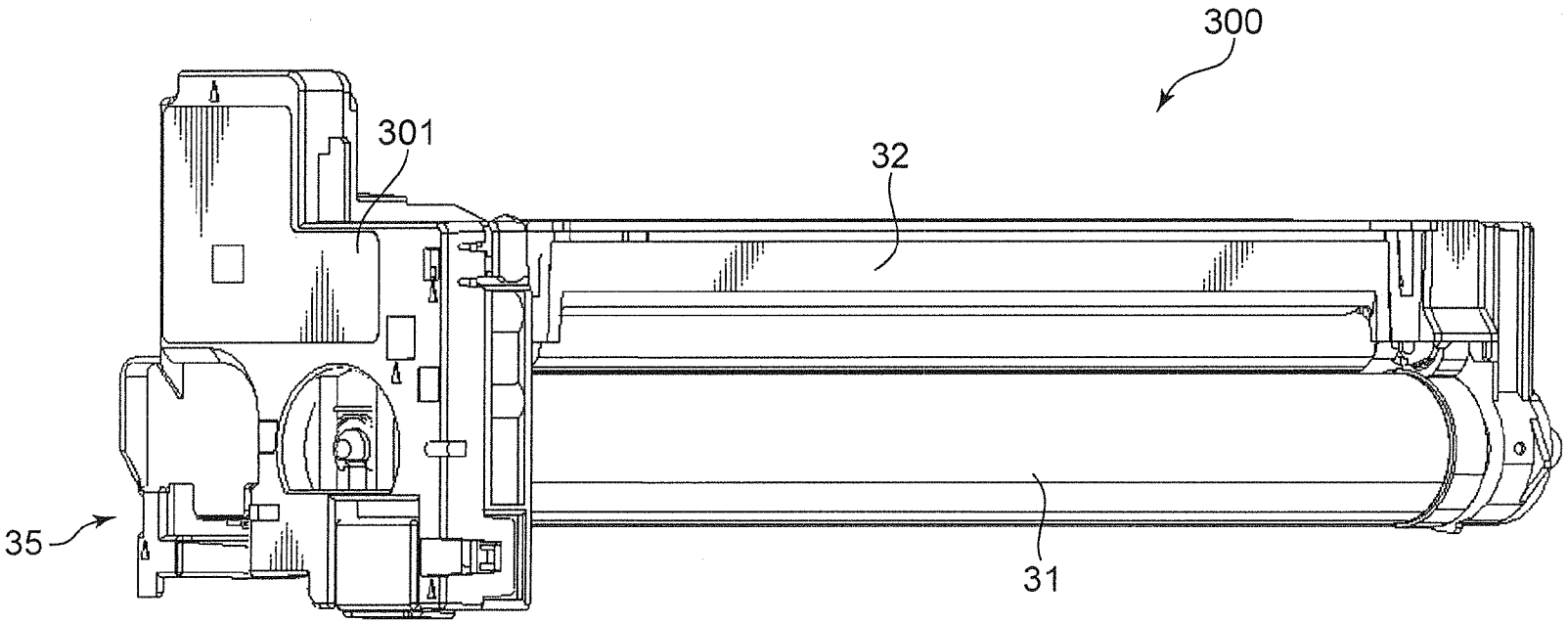
FIG. 3 is a perspective view of a drum unit shown in FIG. 2, as seen from an obliquely front direction.
Figure 4:
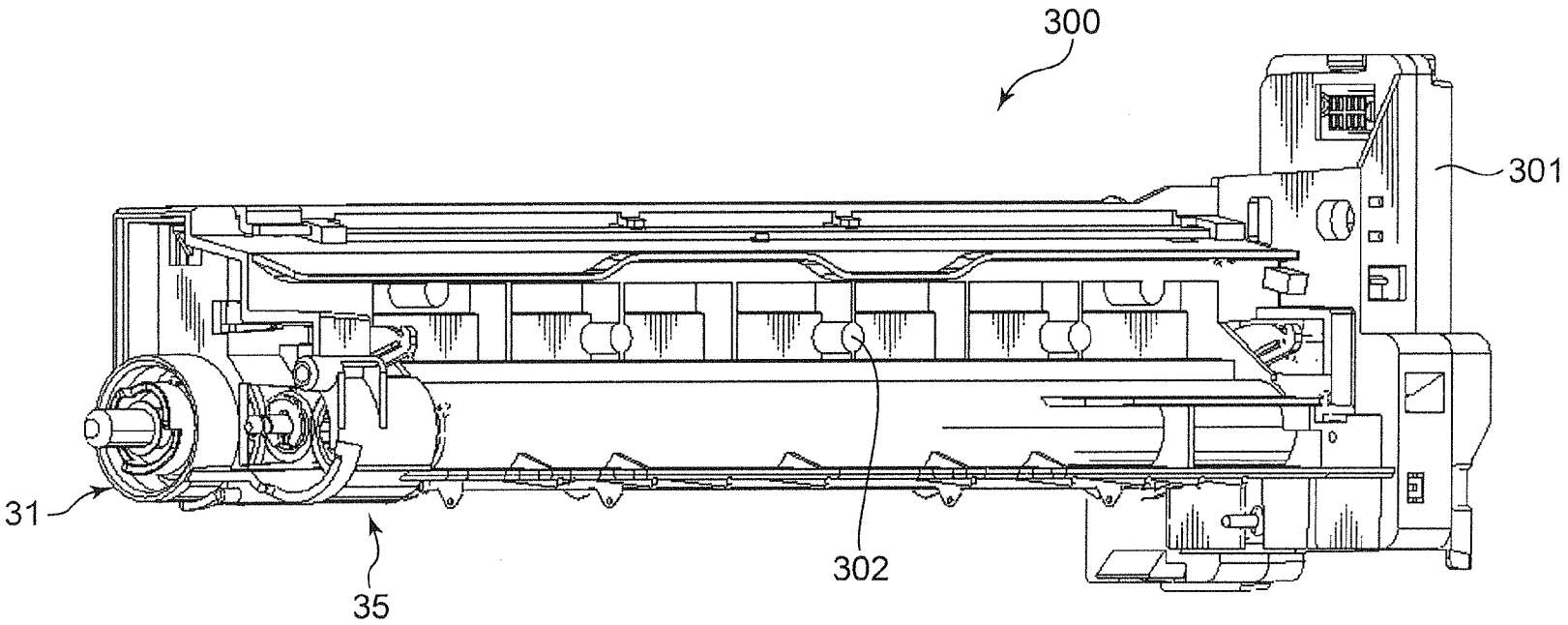
FIG. 4 is a perspective view of the drum unit shown in FIG. 2, as seen from an obliquely rear direction.

In this embodiment, as shown in FIGS. 3 and 4, the photosensitive drum 31, the charging device 32 and the cleaning mechanism 35 constitute one drum unit 300. The cleaning mechanism 35 is housed in an inner space surrounded by a side cover 301 and a housing 302 of the drum unit 300 (see FIG. 5).

The photosensitive drum 31 rotates about the axis thereof, and an electrostatic latent image and a toner image are formed on the circumferential surface of the photosensitive drum 31. A photosensitive drum using an amorphous silicon(a-Si)-based material is used as the photosensitive drum 31. The charging device 32 uniformly charges the surface of the photosensitive drum 31, and includes a charging roller to be contacted with the photosensitive drum 31. The exposure device has an optical system device such as a laser light source, a mirror and a lens. The exposure device irradiates, onto the circumferential surface of the photosensitive drum 31, light that has been modulated based on image data outputted from an external device such as a personal computer, for forming an electrostatic latent image.

The developing device 33 supplies toner to the circumferential surface of the photosensitive drum 31 for developing the electrostatic latent image on the photosensitive drum into a toner image. The developing device 33 includes a developing roller 331 for carrying toner to be supplied to the photosensitive drum 31, and a first transport screw 332 and a second transport screw 333 for circulating and transporting a developer (toner) while stirring the developer in a developer housing (not shown).

The transfer roller 34 is a roller for use in transferring a toner image formed on the circumferential surface of the photosensitive drum 31 onto a sheet, and forms a transfer nip portion with the photosensitive drum 31. A transfer bias voltage of a polarity opposite to the polarity of toner is applied to the transfer roller 34.

The cleaning mechanism 35 is a mechanism for removing matter adhered to the surface of the photosensitive drum 31 after toner image transfer processing. The structure of the cleaning mechanism 35 will be described later in detail.

The fixing unit 40 performs a fixing processing of fixing a transferred toner image onto a sheet. The fixing unit 40 includes a fixing roller 41 with a heating source provided therein, and a pressure roller 42 in pressing contact with the fixing roller 41 for forming a fixing nip portion with the fixing roller 41. When a sheet on which toner image is just transferred passes through the fixing nip portion, the toner image is fixed onto the sheet by the heat applied from the fixing roller 41 and the pressure applied from the pressure roller 42.

The toner container 50 stores toner (developer) which is supplied to the developing device 33. The toner container 50 includes a container body 51 serving as a main storage of toner, and a rotating member 54 which is housed in the container body 51 for transporting the toner. The toner stored in the toner container 50 is transported to the inside of the container body 51 by rotating and driving the rotating member 54, and is supplied into the developing device 33 through a toner discharge port 521.

The housing body 10 is internally formed with a main transport path 22F and a switchback transport path 22B for transporting a sheet. The main transport path 22F extends from the sheet feeding unit 20, via the image forming unit 30 and the fixing unit 40, to a sheet discharge port 14 which is formed as opposed to the sheet discharge unit 13 disposed on the top surface of the housing body 10. The switchback transport path 22B is a transport path for use in returning a sheet after one-side printing to the upstream side of the image forming unit 30 in the main transport path 22F, in the case where double-sided printing is performed for the sheet.

A registration roller pair 23 is disposed, in the main transport path 22F, at an upstream side of the transfer nip portion to be formed between the photosensitive drum 31 and the transfer roller 34. Transport of a sheet is temporarily stopped by the registration roller pair 23 for skew correction, and thereafter, is fed to the transfer nip portion at a predetermined timing for image transfer.

(Description on Cleaning Mechanism 35)

Figure 5:
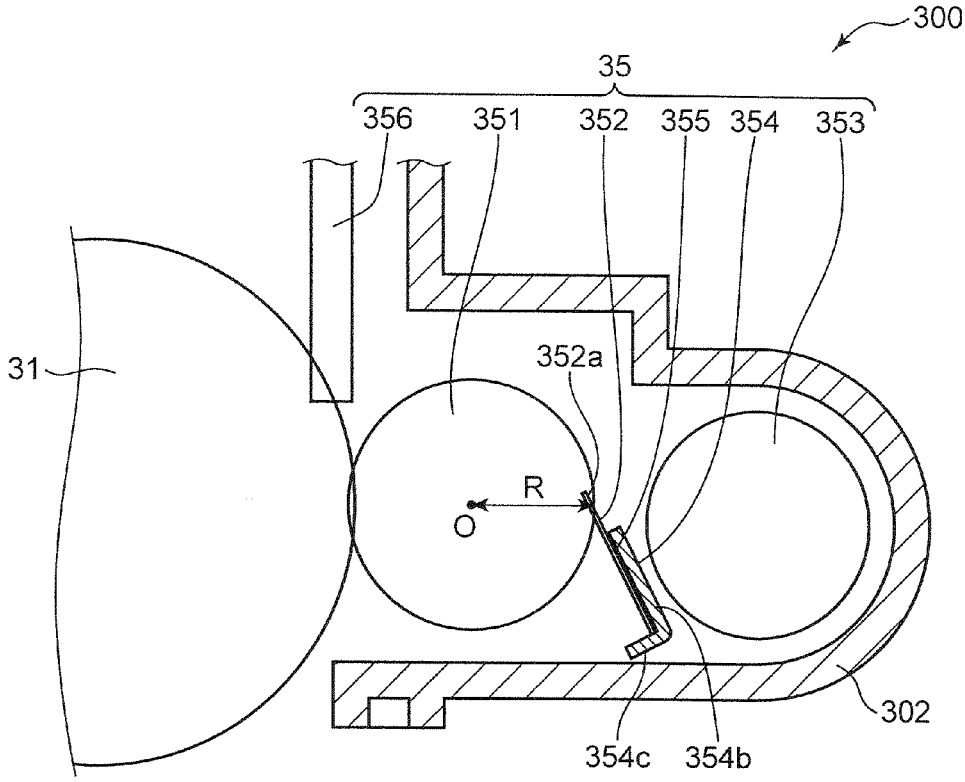
FIG. 5 is an enlarged sectional view of the drum unit shown in FIG. 2.
Figure 6:
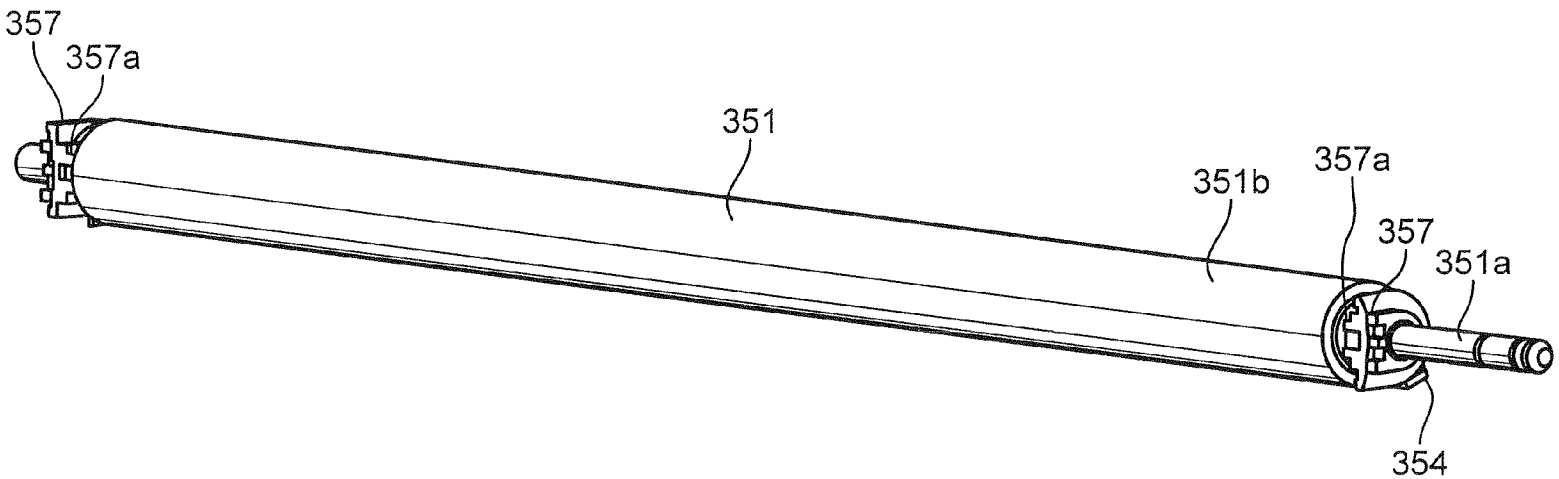
FIG. 6 is a perspective view of a rubbing roller and peripheral members thereof shown in FIG. 5, as seen from an obliquely front direction.

As shown in FIG. 5, the cleaning mechanism 35 is provided with a rubbing roller 351, a scraper (toner amount restricting plate) 352, a disposal screw 353, a bracket 354, a double-sided adhesive tape 355, a cleaning blade 356, and bearings 357 (see FIG. 6).

The rubbing roller 351 is a roller to be contacted with the surface of the photosensitive drum 31. A shaft portion 351*a* protruding from both ends of the rubbing roller 351 is rotatably supported by the bearing pair 357. A roller body 351*b* of the rubbing roller 351 is made of foamed synthetic rubber or a like material. Toner transported via the photosensitive drum 31 or the vicinity thereof is adhered to the surface of the roller body 351*b* of the rubbing roller 351. The rubbing roller 351 is abrasively contacted with the surface of the photosensitive drum 31, with use of the toner as an abrasive agent, for removing the matter adhered to the surface of the photosensitive drum 31.

The scraper 352 restricts the amount of toner adhered to the surface of the rubbing roller 351, and corresponds to the toner amount restricting plate of the present disclosure. The scraper 352 is formed of a metal sheet made of e.g. stainless steel. The scraper 352 is disposed along a direction perpendicular to the plane of FIG. 5 in such a manner as to extend in parallel to the axis direction of the rubbing roller 351 and in contact with the rubbing roller 351.

Figure 7:
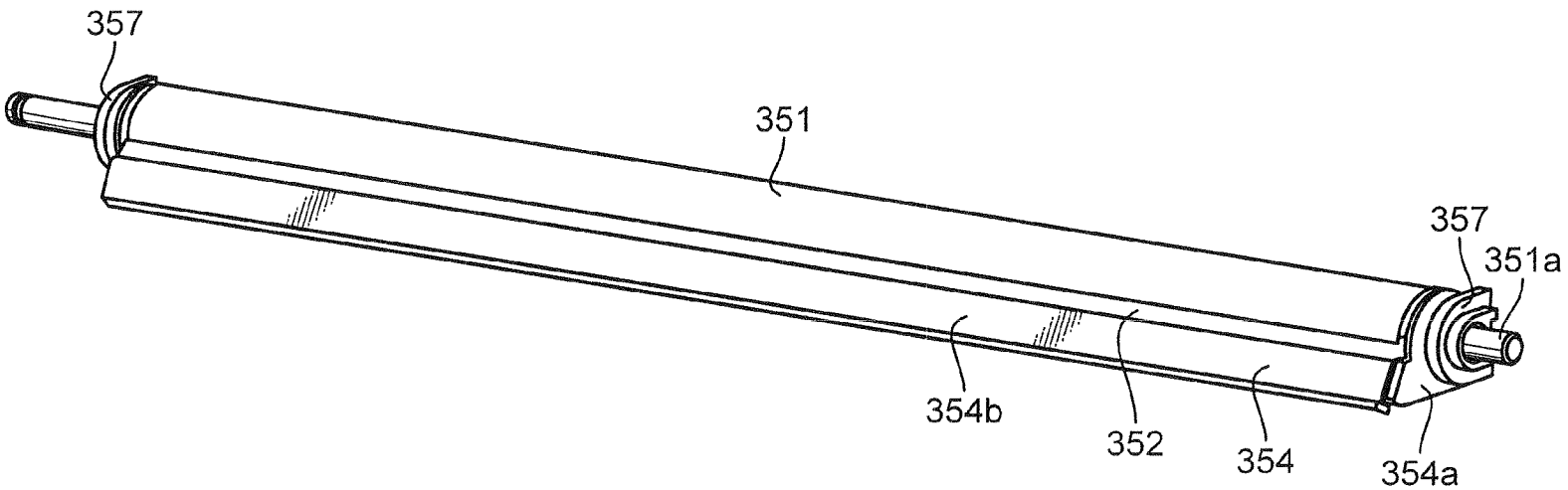
FIG. 7 is a perspective view of the rubbing roller and the peripheral members thereof shown in FIG. 5, as seen from an obliquely rear direction.
Figure 8:
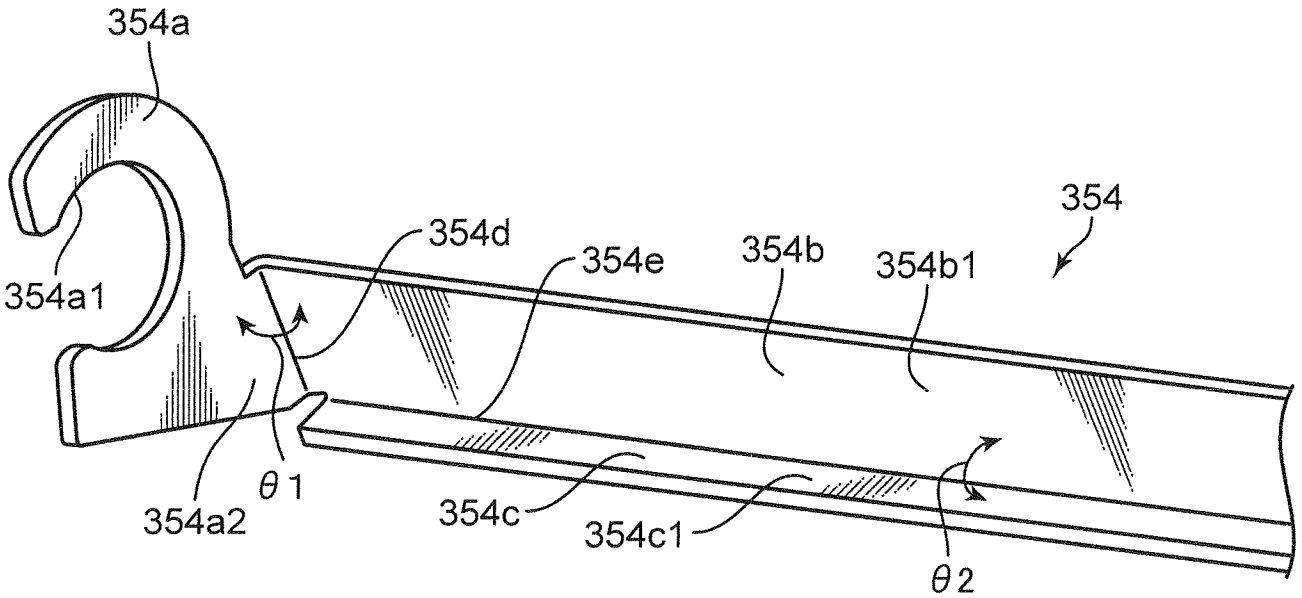
FIG. 8 is an enlarged perspective view of a bracket shown in FIG. 5, as seen from an obliquely front direction.

As shown in FIG. 5 and FIG. 8, the bracket 354 is a member for holding the scraper 352 in a state that the scraper 352 is contacted with the rubbing roller 351. The bracket 354 has a pair of bearing holding portions 354*a*, a scraper mounting portion 354*b*, and a scraper positioning portion 354*c*. The bracket 354 is manufactured by bending a metal sheet made of e.g. steel in such a manner that the bearing holding portions 354*a* (see FIG. 7), the scraper mounting portion 354*b* and the scraper positioning portion 354*c* are formed into a one-piece member.

The bearing holding portions 354*a* respectively hold the pair of bearings 357 (see FIG. 6). Specifically, the bearing holding portions 354*a* are constituted of a pair of C-shaped thin plates. The bearing holding portions 354*a* each holds the corresponding bearing 357 by engagement between an inner periphery 354*a*1 of the bearing holding portion 354*a* and a step portion 357*a* (see FIGS. 6 and 7) of the corresponding bearing 357.

The scraper mounting portion 354*b* is made of an elongated thin plate extending between the pair of bearing holding portions 354*a*. The scraper mounting portion 354*b* has a scraper mounting surface 354*b*1 to which the flat plate-shaped scraper 352 is fixedly mounted. The scraper 352 is fixedly mounted to the scraper mounting surface 354*b*1 in a plane contact state.

The bearing holding portion 354*a* and the scraper mounting portion 354*b* continue to each other via a first bent portion 354*d* which is bent at a first angle 1.

In this example, as shown in FIG. 8, since the bearing holding portion 354*a* has an outer periphery formed into an outwardly projecting portion 354*a*2, it is possible to sufficiently secure a length for the first bent portion 354*d*. Thus, it is possible to widen the width of the scraper mounting portion 354*b*, and increase the area for the scraper mounting surface 354*b*1.

The scraper positioning portion 354*c* is constituted of an elongated thin plate adjoining the scraper mounting portion 354*b*. The scraper positioning portion 354*c* has a scraper positioning surface 354*c*1 for positioning the scraper 352 which is adhesively mounted to the scraper mounting surface 354*b*1. The scraper 352 is positioned by contacting a lower end edge of the scraper 352 with the scraper positioning surface 354*c*1.

The scraper positioning portion 354*c* and the scraper mounting portion 354*b* continue to each other via a bent portion different from the first bent portion 354*d*, specifically, a second bent portion 354*e* which is bent at a second angle 2. The scraper positioning portion 354*c* and the scraper mounting portion 354*b* extend in parallel to each other, with the second bent portion 354*e* interposed therebetween.

As shown in FIG. 5, the double-sided adhesive tape 355 is provided between the scraper 352 and the scraper mounting portion 354*b*1, for adhesively mounting the scraper 352 to the scraper mounting surface 354*b*1 (see FIG. 8) of the scraper mounting portion 354*b*. The length of the double-sided adhesive tape 355 is preferably equal to the overall length of the scraper 352, but may be shorter than the overall length of the scraper 352.

The disposal screw 353 transports disposable matter such as toner residues in the housing 302 of the cleaning mechanism 35 to a predetermined disposal site. The disposal screw 353 is disposed along a direction perpendicular to the plane of FIG. 5 in such a manner as to extend in parallel to the rubbing roller 351.

The cleaning blade 356 is constituted of a thin plate made of e.g. synthetic resin. The cleaning blade 356 scrapes off matter such as toner residues produced after image formation by contact with the surface of the photosensitive drum 31. Part of the scraped-off toner residues is adhered to the surface of the rubbing roller 351.

In the case where the scraper 352 is mounted to the bracket 354 configured as described above, as shown in FIG. 5 and FIG. 8, firstly, the lower end edge of the scraper 352 is abutted against the scraper positioning surface 354*c*1 of the scraper positioning portion 354*c* in a state that one face of the double-sided adhesive tape 355 is attached to the scraper 352, for positioning the scraper 352 in parallel to the scraper mounting surface 354*b*1 of the scraper mounting portion 354*b*. Thereafter, the other face of the double-sided adhesive tape 355 attached to the scraper 352 is attached to the scraper mounting surface 354*b*1, whereby the mounting of the scraper 352 is completed.

Thereafter, the bearings 357 (see FIGS. 6 and 7) for supporting the shaft portion 351*a* at both ends of the rubbing roller 351 are held by the bearing holding portions 354*a* of the bracket 354. By performing the above operation, as shown in FIG. 5, the scraper 352 is fixedly mounted in a state that the scraper 352 is contacted with the surface of the rubbing roller 351 with a predetermined amount of bite.

The amount of bite of the scraper 352 with respect to the rubbing roller 351 is, e.g. as shown in FIG. 5, expressed by a displacement amount by which a tip end 352*a* of the scraper 352 moves in a radial direction R of the rubbing roller 351 toward a center O of rotation of the rubbing roller 351.

The rubbing roller 351, the bearings 357 and the bracket 354 as shown in FIGS. 6 and 7 are housed in the housing 302 of the drum unit 300 as one unit.

(Comparative Example)

Figure 9:
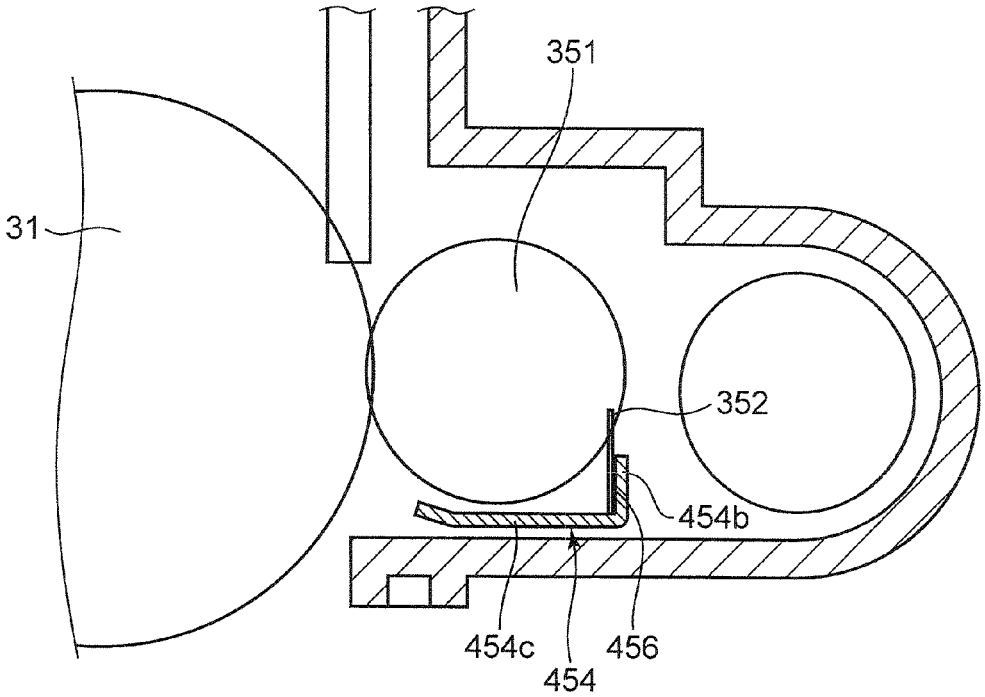
PRIOR ART FIG.9
FIG. 9 is an enlarged sectional view of a conventional drum unit as a comparative example of the present disclosure.
Figure 10:
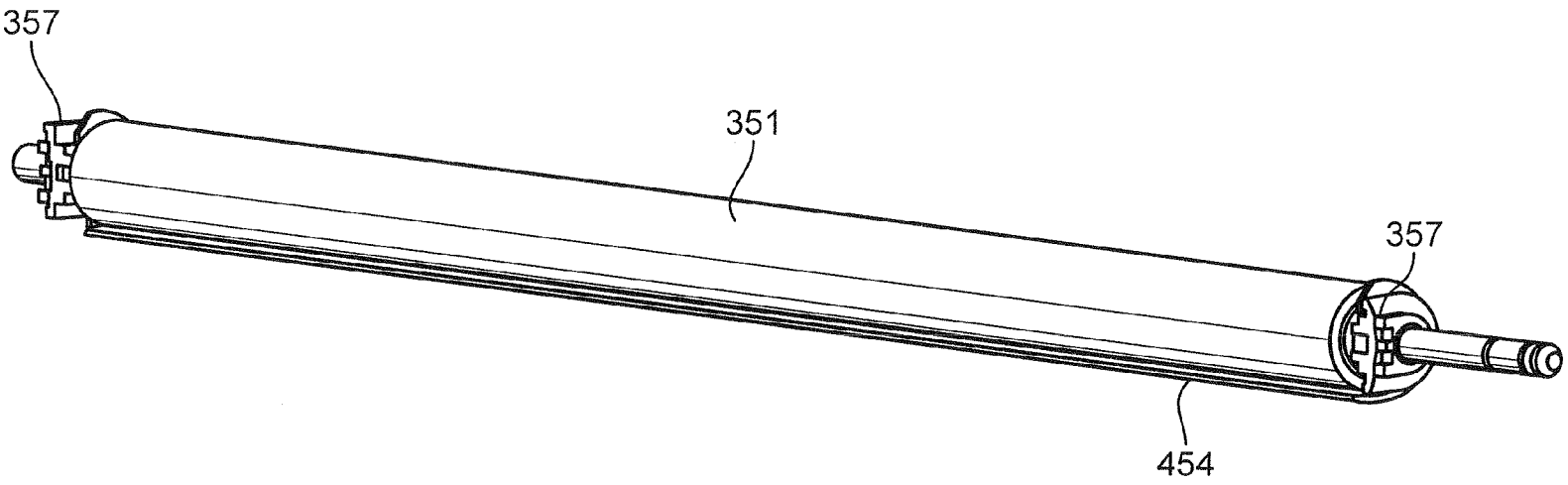
PRIOR ART FIG.10
FIG. 10 is a perspective view of a rubbing roller and a periphery thereof shown in FIG. 9, as seen from an obliquely front direction.
Figure 11:
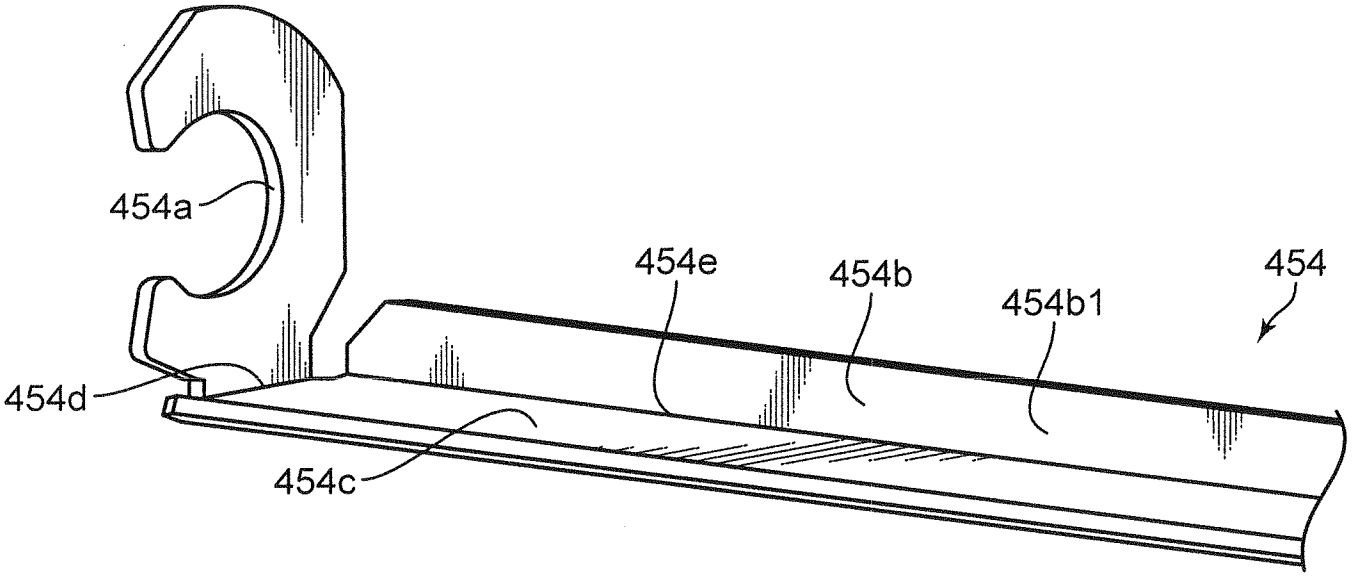
PRIOR ART FIG. 11
FIG. 11 is an enlarged perspective view of a bracket shown in FIG. 9, as seen from an obliquely front direction.

In this section, a comparative example of the present disclosure is described referring to a conventional bracket 454 shown in FIGS. 9 through 11. As shown in FIGS. 9 through 11, the conventional bracket 454 has a first bent portion 454*d* between a bearing holding portion 454*a* and a scraper positioning portion 454*c*, and a second bent portion 454*e* between the scraper positioning portion 454*c* and a scraper attaching portion 454*b*. Thus, the bearing holding portion 454*a* and the scraper attaching portion 454*b* continue to each other via the two bent portions 454*d* and 454*e*.

In the above configuration, in the case where the bending angle of an attachment surface 454*b*1 varies within the dimensional tolerance in e.g. forming the bracket 454, the amount of bite of a scraper 352 with respect to a rubbing roller 351 greatly changes. As a result, the ability of restricting the toner amount (toner transport amount) on the surface of the rubbing roller 351 by the scraper 352, in other words, a toner restricting force may be unstable. Further, if the amount of bite of the scraper 352 excessively increases, the torque of the rubbing roller 351 may increase, or the scraper 352 may be disengaged from the bracket 354.

Further, in the aforementioned configuration, the scraper 352 is attached to the scraper attaching portion 454*b* in a state that the two bent portions 454*d* and 454*e* are formed between the bearing holding portion 454*a* and the scraper attaching portion 454*b*. With this configuration, it is difficult to sufficiently secure the area for attaching the scraper 352 to the scraper attaching portion 454*b*. Therefore, it is necessary to form a thermal adhesive portion 456 (see FIG. 9) by adhesive attachment with use of a hot-melt process capable of providing a strong adhesive force. This results in an increase in the number of assembling steps or the manufacturing cost, as compared with a configuration that the double-sided adhesive tape 355 (see FIG. 5) is used for attaching the scraper 352 to the scraper attaching portion 454*b*, as described in the embodiment.

In contrary to the above comparative example, as described the above embodiment, in the cleaning mechanism 35 of the embodiment, the bearing holding portion 354*a* and the scraper mounting portion 354*b* of the bracket 354 continue to each other via the first bent portion 354*d*. Accordingly, in the case where the bracket 354 is formed by bending a metal sheet, there is formed only one bent portion i.e. the bent portion 354*d* between the bearing holding portion 354*a* and the scraper mounting portion 354*b*. This is advantageous in suppressing variation in the amount of bite of the scraper 352 mounted to the scraper mounting portion 354*b* with respect to the rubbing roller 351. With this configuration, variation in the toner transport amount on the surface of the rubbing roller 351 is reduced. This makes it possible to control the toner transport amount to an desired value, and suppress various drawbacks such as toner drop, formation of a pinhole, or image blurring. Furthermore, the above configuration suppresses an excessive increase in the amount of bite of the scraper 352. This eliminates drawbacks such as an increase in the torque of the rubbing roller 351 or disengagement of the scraper 352.

Further, the scraper mounting portion 354*b* continues to the bearing holding portion 354*a* via the bent portion 354*d*. This is advantageous in suppressing an influence on dimensional precision of the scraper mounting surface 354*b*1 for mounting the scraper 352 even if the size of the scraper mounting portion 354*b* is increased. Thus, it is possible to sufficiently secure the area for the scraper mounting surface 354*b*1. This eliminates the need of using means such as a hot-melt device capable of providing a strong adhesive force for mounting the scraper 352 to the scraper mounting surface 354*b*1, and secures sufficient attachment strength by the double-sided adhesive tape 355.

In the cleaning mechanism 35 of the embodiment, the scraper positioning portion 354*c* for positioning the scraper 352 continues from the scraper mounting portion 354*b* via the second bent portion 354*e* which is different from the first bent portion 354*d*, without via the bearing holding portion 354*a*. This is advantageous in forming the scraper positioning portion 354*c* without affecting the dimensional precision of the scraper mounting portion 354*b*.

In the cleaning mechanism 35 of the embodiment, it is easy to adhesively mount the scraper 352 to the scraper mounting surface 354*b*1 by the double-sided adhesive tape 355. This is advantageous in suppressing the number of assembling steps and the manufacturing cost.

In the embodiment, the scraper 352 is attached to the scraper mounting portion 354*b* in a state that the scraper 352 is positioned by the scraper positioning portion 354*c*. The present disclosure is not limited to the above. For instance, the scraper 352 may be attached to the scraper mounting portion 354*b* in a state that the scraper 352 is positioned relative to the scraper mounting portion 354*b* with use of a jig. In the modification, since the scraper positioning portion 354*c* can be omitted, the structure of the bracket 354 can be more simplified, and the manufacturing cost can be further reduced.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning mechanism for removing matter adhered to a surface of a photosensitive drum, comprising:

a rubbing roller that is abrasively contacted with the surface of the photosensitive drum;

a bearing that rotatably supports the rubbing roller;

a toner amount restricting plate that restricts an amount of toner adhered to a surface of the rubbing roller; and a bracket that holds the toner amount restricting plate in a state that the toner amount restricting plate is contacted with the rubbing roller, wherein the bracket includes a bearing holding portion that holds the bearing, a toner amount restricting plate mounting portion having a mounting surface to which the toner amount restricting plate is fixedly mounted adhesively, and a toner amount restricting plate positioning portion having a positioning surface for positioning the toner amount restricting plate, the bearing holding portion extending continuously from the toner amount restricting plate mounting portion via a first bent portion, the toner amount restricting plate positioning portion extending continuously from the toner amount restricting plate mounting portion via a second bent portion different from the first bent portion, and the toner amount restricting plate having an end edge contacting the positioning surface for positioning the toner amount restricting plate.

2. The cleaning mechanism according to claim 1, further comprising:

a double-sided adhesive tape which adhesively mounts the toner amount restricting plate to the mounting surface.

3. An image forming apparatus, comprising:

a photosensitive drum; and the cleaning mechanism of claim 1 for removing matter adhered to a surface of the photosensitive drum.

* * * * *